United States Patent [19]

Boekholt

[11] Patent Number: 4,652,068

[45] Date of Patent: Mar. 24, 1987

[54] SELF-LIGHTING SECURITY HANG-UP DEVICE

[76] Inventor: Bernard P. Boekholt, 29 rue du Docteur Roux, 92330 Sceaux, France

[21] Appl. No.: 764,317

[22] Filed: Aug. 9, 1985

[30] Foreign Application Priority Data

Aug. 10, 1984 [FR] France ..... 84 12670

[51] Int. Cl.[4] ..... F21S 1/00; H01R 41/00

[52] U.S. Cl. ..... 339/2 L; 362/427; 362/432

[58] Field of Search ..... 339/1 R, 2 L; 362/426, 362/428, 432, 401, 427; 211/26; 248/291, 293

[56] References Cited

U.S. PATENT DOCUMENTS 3,642,238 2/1972 Kapnek ..... 362/432 X 3,856,251 12/1974 Miller ..... 362/401

*Primary Examiner*—Eugene F. Desmond

*Attorney, Agent, or Firm*—Cohen, Pontani & Lieberman

[57] ABSTRACT

The present invention is related to a hang-up device of the type comprising a metallic suspension rail and hooking-on sliders.

It is characterized in that it comprises at least two electrically conductive rails supplied with low-voltage current and isolated from each other, on which rails sliders are mounted that ensure the isolation between the rails, at least one of them being provided with two arms one end of which is hingedly connected to said slider or sliders, while the other one carries a light-carrying housing, at least two conductive arms being electrically connected each, on the slider side, to one of the rails and on the other side to the housing, thus ensuring the supply of the light-carrying housing with low-voltage current.

12 Claims, 1 Drawing Figure

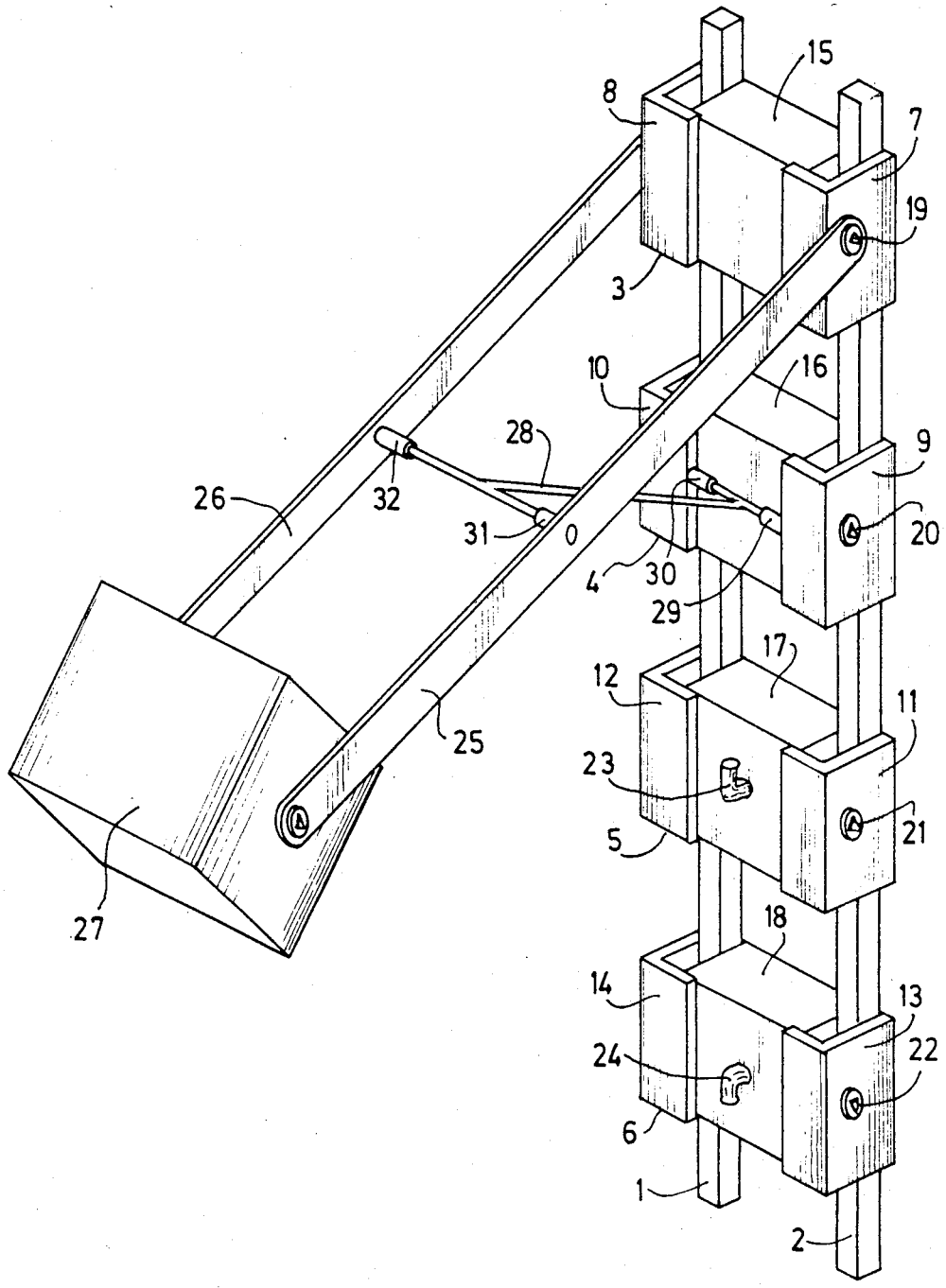
15
8
7
19
3
10
16
28
9
26
32
31
0
20
4
30
29
17
12
11
25
23
21
5
27
18
14
13
24
22
6
1
2

SELF-LIGHTING SECURITY HANG-UP DEVICE

FIELD OF THE INVENTION

The present invention is related to a self-lighting security hang-up device.

When it is desired to hang up against a wall works of art, such as paintings, photographs, engravings and the like, especially in premises which are accessible to the public, such as museums, art-galleries, show-rooms, etc., problems are encountered with regard to security (on account of the great number of thefts occurring in such places) and lighting the objects to be hung up (especially in temporary show-rooms where the displays are bound to be frequently changed.)

Now the security problem requires rendering difficult the fixing and removal of the related objects, whereas the concept of temporary show or exhibition requires the provision of means adapted to allow the fixing mode and the lighting means to be easily modified, allowing them to be adapted to a great number of widely varying conditions.

The present invention is aimed at providing a solution to the problem raised by the structure of the so-called "hanging-up" means which should be inviolable and at the same time flexible in use.

BACKGROUND OF THE INVENTION

The most widespread hang-up methods use conventional devices of the cyma or overhanging counter-rail type, which comprise a horizontal support member onto which vertical rod members, generally made of a metallic material, are hooked, said rod members being provided with one or more hooks adjustable in height. Chains or other suspension means are also used. Most of these known devices are extremely flexible in use, and they are generally utilized in art-galleries and other showrooms. However they fail to offer a satisfactory solution of the security problem and the lighting problem.

The conventional lighting means are generally arranged for "overall lighting", i.e. for distributing the light rather uniformly over the entire wall surface, thus without taking into account the orientation of the different works of art to be shown, and, more particularly, their hang-up angle; furthermore, such arrangement does not take into account the either more or less reflecting nature of the surface of the works of art; consequently, in many show-rooms, which are apparently well lighted, the public is obliged to move to and fro for a considerable period of time in front of every work of art before a position is found from which the work of art can be viewed in a well-lighted condition without undesirable reflection—if such a position can be found at all.

It is noted that individual lighting of each work of art is difficult to achieve, since this method requires the provision of electric installations comprising loose wires and series of connecting devices or metal sections, which generally renders the arrangement entirely unaesthetic and involves fastidious mounting and adjusting operations.

According to another approach projectors are hooked onto, or suspended from the ceiling or beam members located at a certain distance from the hang-up wall; this solution provides for wide-angle lighting, except in the case where the projectors comprise an optical framing system which, while being quite expensive, provides for very precise lighting of a frame without lighting the environing wall. These devices are generally more or less stationary, and their number is very difficult to vary in function of the number of works of art to be exhibited. Furthermore this arrangement, when applied to large halls or galleries, requires the use of ladders or even scaffoldings for adjusting the lighting system. In addition it should be noted that the position of the light sources is not adjustable in most cases, unless considerable expense were involved, and consequently this solution does not overcome the problem of undesirable reflection effects. Furthermore it is known that for security reasons it has become increasingly necessary to provide glass panels in front of the works of art that have been left exposed to the open air up to now, which is the case of oil paintings, for example; this requirement brings about an amplification of the undesirable reflection effect. Now, in most museums and art-galleries visited by the public it is required that a plurality of persons be able to view one given painting without some of those persons being inconvenienced by undesirable reflection effects.

It is thus an object of the present invention to provide a unique device which complies with the hanging-up requirements as well as with the security and lighting requirements, remaining both reliable and flexible in use.

The device according to the invention uses a vertical suspension system including sliders displaceable along at least two metallic—and consequently electrically conductive—rails which are supplied with low-voltage electric current and isolated from each other, certain electrically isolated sliders allowing hanging up the works of art, while other sliders ensure the electric current supply of hinged arms which carry the low-voltage lighting system.

It should be noted that the "low-voltage current" is presently defined by specifications and rules which are in force in individual countries or groups of countries, the definition of this type of current being a matter of regulations rather than a technical matter. At any rate, the main characteristic of the low-voltage current resides in its harmlessness for humans or, in other words, in the fact that the related conductors may be employed with a very light isolation, or no isolation at all, without bringing about an electrocution hazard. This mode of low-voltage current supply by means of parallel, mutually isolated rails has been used on a large scale since electrical toys such as electric toy railways were introduced on the market.

The principle of low-tension (low-voltage) conductive metal sections is applied in many well-known lighting devices, which use, for example, double hinge bars isolated from each other and constituting at the same time an orientable support and electric current conducting means.

Thus in the E.E.C. countries an industry branch has developed which produces lighting systems supplied with 12 V current by means of small transformers included in the base or support of the lighting device, or with halogen-filled bulbs or tubes, the latter allowing, in addition, a lighting substantially equivalent to daylight to be obtained.

Halogen-filled lamps and tubes supplied with alternating or direct current are increasingly used, particularly in automotive vehicles and in stage-lighting systems (theater, cinema, television). They are more and more frequently adopted in the professional field (offices and the like), as well as in the domestic field (lighting of homes, gardens, etc.).

BRIEF DESCRIPTION OF THE INVENTION

With the before-mentioned and other objects in view the present invention provides a hang-up device comprising at least two electrically conductive rod or rail members electrically isolated from, and substantially parallel to, each other and electrically isolated hooking-on sliders adapted to receive at least one object to be hung up, as well as carrier sliders supporting hinged arms adapted to supply current to the position thereof, said sliders being slidingly movable along said rod members.

The hooking-on sliders may be arranged in pairs and provided with mutually opposed hooking-on systems, the arrangement being such that when translationally displaced away from each other or towards each other these systems engage associated systems provided on the back of the work of art to be hung up, while the locking-in-position of said sliders renders the assembly inviolable. By way of example, the sliders may be provided with male elements (fingers, hooks or the like) cooperating with female elements (such as recesses or rings) or female elements may be provided on the sliders and adapted to cooperate with male elements provided on the frame. The method of hanging up paintings or the like is particularly adapted for use in connection with a frame such as disclosed in French patent specification No. 1 574 889.

Preferably two light-carrying sliders are provided. They do not impair the isolation between the rail or rod members, and at least one of said sliders carries two arms each of which is angularly adjustable (i.e. orientable) in a vertical plane adjacent to one rod member and substantially perpendicular to the hang-up wall, said arms remaining substantially parallel to each other and carrying at their free ends an isolating light source-carrying reflector housing, said arms being hingedly connected to the slider, on the one hand, and to said housing, on the other hand, by electrically conductive connecting parts allowing the light source, such as a lamp or a tube, to be supplied with electric current, while the other slider is hingedly connected to one end of at least one electrically isolated hinged arm angularly adjustable in a plane substantially perpendicular to the hang-up wall and parallel to the rod members, the other end of said arm being hingedly connected to light carrier arm assembly.

Due to this arrangement, it is possible, by adjusting the two sliders, to adjust the lighting in height and in distance from the wall and thus from the exposed work of art; furthermore, by rotating the housing, the angular position of the lamp, tube or other light source can be adjusted. It is also possible to mount on said rod members a greater number of sliders for hanging up a plurality of works of art, or a comparatively large and/or heavy work of art, as well as to provide a plurality of light sources. Furthermore it can be envisaged to provide a plurality of groups of rod members mounted parallel to each other, so that a large and/or heavy work of art can be hung up, while it is possible then, at the same time, to provide a plurality of light sources.

The present specification will not take into consideration the elevated hooking-on systems in a detailed manner. In this respect it will indeed be sufficient to provide along the hang-up wall, at an elevated location, at least two parallel conductive bars onto each one of which one of the conductive hang-up rod members is hooked. This may be performed by using simple hooks, provided that the different bar and rod member assemblies are electrically isolated from each other. Said conductive bars may be placed in one or more profiled sections provided with conventional means for isolating the bars from one another, while the hang-up rod members are connected to at least one current-supplying slider of conventional construction. Devices of this kind are well known, and are used in particular for mounting projectors directly onto current-supplying profiled sections. Such devices permit the use of more than two conductors, which allows lighting to be performed by means of a plurality of circuits, for example, with a view to effecting a distribution between different phases, or between such different phases and neutral, or to switch on or off certain lighting means independently from each other.

Furthermore, the following description will also be limited to the simplest arrangement, i.e., the construction comprising two rails, and to the case where a single work of art is to be hung up and where one single lighting housing is provided. Also with a view to simplifying, no description will be made, as already mentioned herein-above, of the arrangement allowing the hooking-on of the upper ends of the rod members. It should be noted that the current supply at 12 V or at a different low tension may be achieved by various means, including generally a transformer connected to the mains, such as 220 V, 50 Hz mains, for example. Depending on the selected lighting system the low-voltage current supply may be in the form of alternating or direct current, this having no influence on the characteristic features of the invention. The transformer, which may or may not be a rectifying transformer, can be placed onto each one of the systems for hooking the rod members onto the horizontal elevated suspension bars, or else said transformer can be placed upstream from the assembly and supply the horizontal bars and thus a plurality of vertical rod or rail member series (or pairs).

For reasons of convenience reference will be made herein to the most general case of horizontal hooking-on bars, a vertical wall and vertical suspension or hang-up rod members, it being well understood, however, that the present device can be adapted to different conditions. In particular, when the rod members are arranged to be slidable along two series of bars or the like, the device may be placed against a ceiling which may or may not be horizontal, in the space defined between the ceiling and the floor, or against an inclined wall, even when overhanging, all the more so as the protected hanging-up of works of art, such as provided by the invention, allows said works to be maintained in an oblique position, and even in a horizontal position, i.e. under the most unfavourable conditions. It will be noted, furthermore, that mounting a series of rod members onto the ceiling, in the space, or in an equivalent manner allows not only the works of art hung up on such rails to be lighted, but can also provide for lighting of works fixed onto other supports as, for example, suspended mobiles, standing sculptures, paintings or the like attached to the wall, posts or poles, folding-screens and so forth.

The above and other objects, features and advantages of the invention will become more clearly apparent from the following description which refers to the appended drawing and is given by way of illustration only, but not of limitation.

BRIEF DESCRIPTION OF THE DRAWING

The single FIGURE of the drawing shows a perspective view of one embodiment of the present invention, the upper portion of the device for hooking the same onto the horizontal bars being omitted, as explained hereinbefore.

DETAILED DESCRIPTION OF THE PREFERRED EMBODIMENT

Rail or rod members 1 and 2 as shown in the drawing are simple metal sections, e.g. square sections. As has already been pointed out, their function consists in suspending the work of art to be exhibited as well as the associated lighting means, and to supply the latter with electric current. Thus said rod members are electrically accessible (or exposed) along at least one of their longitudinal surfaces; i.e., they are bared at said location so as to provide electric contact with the sliders 3 and the light source carrying means 4, which elements are mechanically connected to said rod members, as shown in the FIGURE.

Light-carrying sliders 3 and 4 as well as object-carrying sliders 5 and 6 ("object" designating generally a work of art of the like) may be fundamentally of an identical structure. They comprise each a slide block 7, 9, 11, 13 and 8, 10, 12, 14, respectively mounted on the rails or rod members, the two slide blocks of each pair being interconnected by an isolating element 15, 16, 17, 18 which is constituted in the present embodiment by a plate made, for example, of plastic material. For reasons of ease of manufacture, and also for aesthetic reasons the general conception of all of the sliders is identical; in the example shown, each slider comprises two slide blocks constituted by segments of profiled metal sections which are fixed to the central isolating plate by means of screws 19, 20, 21, 22 and symetrically disposed screws (not visible in the FIGURE). Such fixation by screws allows the associated rod member to be gripped and to lock the slide blocks of the sliders, thus providing mechanical positioning as well as the indispensable electrical contact, as regards the light-carrying sliders. For achieving such contact the metal sections need only be maintained in engagement with at least one bared surface of the corresponding rod member.

Obviously slide blocks 11, 12, 13, 14 of object-carrying sliders 5 and 6 may be made of an isolating material. It is only imperative that said object-carrying sliders will not short-circuit rod members 1 and 2.

The clamping screws preferably have heads which require a special tool to be used, such as cylindrical heads provided with a polygonal or star-shaped recess, which renders dismounting difficult when no such special tool is at hand.

Plates 17, 18 of the object-carrying sliders 5, 6 are provided each with an object-holding element adapted to maintain the work of art or the like to be hung up, which element cooperates with corresponding opposite elements provided on said object. Holding elements 23, 24 of the sliders are male elements in the example shown and are adapted to cooperate with female elements of the object, for example female elements of a frame as disclosed in the above-mentioned French patent specification. The holding elements of the slides may also be female elements adapted to cooperate with male elements of such frame or other object to be hung up. Sliding displacement of the sliders (in accordance with the example shown, such displacement moves the related sliders away from each other, while in a modified embodiment this displacement may move them toward one another) will result in mutual engagement of the holding elements of said sliders with those of said object. When screws 21, 22 and the corresponding symetrically mounted screws are then tightened the object is positively fixed and can be removed only when the entire assembly is moved as far away from the wall as possible to render the screws accessible, and when the above-mentioned special tool is then used. Thus it is seen that this hang-up system is substantially inviolable. It may be still more inviolable when the rod members are maintained at their lower ends and thus cannot be moved away from the wall unless the upper horizontal bars are removed, which operation requires the use of a ladder or the like and thus is quite difficult to perform during the hours when the show room is open to the public.

The frame or other object may also be provided with projections adapted to hide the sliders and to render the screws inaccessible when the entire assembly is mounted in place onto the hang-up wall. As regards light-carrying sliders 3, 4, one of the same (slider 3 in the example shown) carries two substantially parallel metallic arms 25, 26 hingedly connected, e.g. by means of screw 19 and its symmetrical counter-part (not visible in the FIGURE), or by means of studs, to slide blocks 7, 8, whereby the electrical contact between the rod members, the slide blocks, said screws and/or studs and the arms is established.

Said arms are able to rotate or pivot in vertical planes in the vicinity of the rod members and substantially perpendicular to the wall against which the device is mounted. The free ends of arms 25, 26 carry a light-carrying housing 27 which is preferably made of an isolating material and is mounted so as to be rotatable on the ends of said arms, the pivot axes being electrically conductive so as to supply current to the tube or lamp bulb mounted together with a reflector (not shown in the FIGURE) in said housing. An arm 28 is provided which may be H-shaped, and has an elongated transverse rod extending between two perpendicular parts 28', 28" which constitute hinge axes for hinged connection, on the one hand, with slider 4 and, on the other hand, with arms 25, 26. This assembly is to be mounted is such a manner that it will not short-circuit slide blocks 13, 15 or arms 25, 26, which latter are thus divided into two portions the respective lengths of which may be equal or different. The "H" structure thus can be entirely isolating, or it may be conductive but mounted on isolating rings or tubes 29, 30, 31, 32. It will be seen that, provided the dimensions of the different elements and the position or location of the hinge connection between the arms 25, 26 and 28 are conveniently selected, the entire assembly will be in neutral equilibrium, i.e. when slider 4 is fixed, slider 3 can slide freely, whereby it is possible to adjust the position of arms 25, 26 and light-carrying housing 27, so that the system involving tightening of screws (such as 19 and its symmetrical counter-part) can be omitted. Thus the assembly obviously will remain in any position which has been selected by the user.

This is the case, for example, when arms 25 and 26 have substantially twice the length of arm 28, the hinge connected between said elements being located substantially in the middle of arms 25, 26, the weight of arms 25, 26 and 28 and that of slider 8 being negligible with reference to the frictional forces. In the example shown, the application of this principle allows the housing 27 to be moved towards or away from the hang-up wall while remaining at the same height, to wit the height of hinge connection 28'', 29, 30 to the supposedly fixed slider 4, slider 3 being movable. As shown in the FIGURE, slider 3 carrying arms 25, 26 is located above slider 4 carrying arm 28, which is convenient for lighting an object placed at a lower location, housing 27 which carries the light source being located substantially at the same height as slider 4. However this arrangement may be reversed when it is desired to light an object from below, which is the case when said object has a comparatively great height and when it is preferred to light said object from above as well as from below.

In the embodiment shown, arms 25, 26 are constituted by flat material, H-shaped arm 28, 28', 28'' is constituted by round material, and housing 27 is a rectangular parallelepiped. This is the result of aesthetic rather than technical considerations, and those skilled in the art may envisage numerous variants and modifications without departing from the spirit and scope of the invention as defined in the appended claims. This also applies to the proportions of the various elements, the arms as shown having been shortened with respect to the preferred embodiment of the invention, in order to improve the clarity of the drawing.

What is claimed is:

1. A hang-up device, comprising:

at least two electrically conductive metallic hang-up rod members supplied with low-voltage current and electrically isolated from each other;

a plurality of sliders mounted on said rod members and ensuring said electrical isolation therebetween;

hooking-on means on at least a first one of said sliders for supporting an object;

at least two electrically conductive first arms carried on a second one of said sliders; and a light source-carrying housing;

one end of each said first arm being hingedly connected to said second slider and the other end of each said first arm being connected to said light source-carrying housing;

and each of said arms being electrically connected at said one end thereof through said second slider to at least one of said rod members, and at said other end thereof to said housing, so as to supply the light source carried in said housing with low-voltage current.

2. A device according to claim 1, further comprising at least one bracing are hingedly connected at one end thereof to a third one of said plural sliders and hingedly connected at the other end thereof to said first arms, and isolating means for preventing electric current from flowing through the hinge connection between said bracing arm and said third slider and through the hinge connection between said bracing arm and said first arms.

3. A device according to claim 2, wherein said bracing arm hingedly connected to said third slider has the shape of an "H" and includes a traverse bar and two perpendicular end bars which constitute the hinge connections to said third slider and said first arms, respectively.

4. A device according to claim 2, wherein said first arms have a length equalling substantially twice the length of said bracing arm, and wherein the hinge connection of said first arms to said bracing arm is located substantially in the middle of said first arms.

5. A device according to claim 1, further comprising means on at least some of said sliders for fixing said sliders onto at least one of said rod members.

6. A device according to claim 1, further comprising a plurality of assemblies including sliders, arms and light source-carrying housing.

7. A device according to claim 1, further comprising a plurality of hooking-on means on said sliders.

8. A device according to claim 1, wherein each said slider comprises a metallic element mounted on an isolating element.

9. A device according to claim 8, wherein each said metallic element is fixed onto the isolating element by at least one screw, the tightening of which fixes the respective slider to the rod member.

10. A device according to claim 1, wherein two object-carrying sliders are provided with opposed hooking-on means for cooperative supporting engagement with an object, and wherein cooperative engagement of said hooking-on means with the object is effected by relative translational sliding motion of said two object-carrying sliders along said rod members.

11. A device according to claim 10, further comprising means on said object-carrying sliders for attachment to at least one said rod member.

12. A device according to claim 1 or 10, wherein said hooking-on means on each object-carrying slider comprises an element for cooperative engagement with an element on the object, one of said elements being male and the other of said elements being female, the cooperative engagement of said elements being initiated substantially parallel to said rod members.

* * * * *